US007225642B2

(12) United States Patent
Katz et al.

(10) Patent No.: US 7,225,642 B2
(45) Date of Patent: Jun. 5, 2007

(54) DIAMOND CUT

(75) Inventors: Philip Katz, New York, NY (US); Isaac Friedman, New York, NY (US)

(73) Assignee: Simka Diamonds, New York, NY (US)

( * ) Notice: Subject to any disclaimer, the term of this patent is extended or adjusted under 35 U.S.C. 154(b) by 0 days.

(21) Appl. No.: 10/658,316

(22) Filed: Sep. 9, 2003

(65) Prior Publication Data

US 2005/0050921 A1 Mar. 10, 2005

(51) Int. Cl.
*A44C 17/00* (2006.01)

(52) U.S. Cl. ..... 63/32; D11/89; D11/90

(58) Field of Classification Search ..... 63/32; D11/89, 90

See application file for complete search history.

(56) References Cited

U.S. PATENT DOCUMENTS

| | | | | | |
|---|---|---|---|---|---|
| 2,364,031 | A | | 11/1944 | Suderov | |
| D141,258 | S | | 5/1945 | Fine | |
| D141,259 | S | | 5/1945 | Fine | |
| D143,470 | S | | 1/1946 | Fine | |
| 3,763,665 | A | | 10/1973 | Polakiewicz | |
| 4,020,649 | A | | 5/1977 | Grossbard | |
| D330,344 | S | * | 10/1992 | Hedgecock | D11/90 |
| D330,873 | S | * | 11/1992 | Kaplan | D11/90 |
| D340,670 | S | * | 10/1993 | Schachter | D11/90 |
| D348,024 | S | * | 6/1994 | d'Haene | D11/90 |
| D411,133 | S | * | 6/1999 | Alvarado | D11/90 |
| 5,970,744 | A | | 10/1999 | Greeff | |
| D439,542 | S | * | 3/2001 | Turner et al. | D11/90 |
| D447,440 | S | * | 9/2001 | Friedman et al. | D11/90 |
| 6,401,489 | B1 | * | 6/2002 | Cheng | 63/32 |
| 6,422,039 | B2 | * | 7/2002 | Bamminger et al. | 63/32 |
| 6,430,963 | B1 | | 8/2002 | Friedman et al. | |
| D476,258 | S | * | 6/2003 | Thatcher | D11/90 |
| D478,529 | S | * | 8/2003 | Yoshida | D11/90 |
| D478,837 | S | * | 8/2003 | Namdar | D11/90 |
| 6,698,239 | B2 | * | 3/2004 | Wueste | 63/32 |
| 2002/0007648 | A1 | * | 1/2002 | Bamminger et al. | 63/32 |
| 2002/0043078 | A1 | * | 4/2002 | Kawabuchi et al. | 63/32 |

* cited by examiner

*Primary Examiner*—William L. Miller
(74) *Attorney, Agent, or Firm*—Feldman Law Group PC

(57) ABSTRACT

A brilliant gemstone cut, having a crown, a girdle and a pavilion. The crown has a flat table shaped as an equilateral n-sided polygon. The girdle is also multi sided polygon. The corner, lower girdle, bezel and star facets are at significantly angles of inclination, with respect to the table to provide significantly improved brilliance.

The upper corner facets are spaced from the girdle. The space between the corner facet vertices and the girdle is left open to be covered by a prong of a jewelry setting.

7 Claims, 3 Drawing Sheets

DIAMOND CUT

FIELD OF THE INVENTION

The present invention relates to the field of diamond cuts. Specifically, the present invention is directed toward diamond cut having a brilliant cut pavilion and a brilliant cut crown. The crown has a flat octagonal table, eight upper girdle facets and eight corner facets. The pavilion has a culet, eight rib lines and multiple lower girdle facets, corner facets and bezel facets, and the lower girdle, bezel star and corner facets. All the facets are at significantly different angles of inclination with the table from the prior art diamond cuts. The upper corner facets are spaced from the girdle so that a prong of a setting can be placed over the crown without covering the corner facet.

BACKGROUND OF THE INVENTION

There are a variety of step and brilliant gemstone cuts available on the market that achieve good coefficients of brilliancy, dispersion and scintillation. However, due to several problems that the prior art presents there is a long felt but unfulfilled need for a better gemstone cut. The present invention fulfils that long felt need by providing a brilliant cut that achieves excellent coefficients of brilliancy, dispersion and scintillation, along with achieving best elegant and classic looks.

There are several U.S. patents available, however, all of them present certain problems and do not fulfill the need for a better diamond cut.

U.S. Pat. No. 2,364,031 to Suderov presents brilliant type cut diamond and a method of cutting it. The diamond cut in this prior art has a table that is in the form of a twelve-sided polygon. The angles of inclination are significantly different in the present invention.

U.S. Pat. No. 3,763,665 to Polakiewiz presents a brilliant cut diamond. This prior art has an octagonal table, eight small facets in a shape of a trapezoid with a large base, eight triangular facets having as its base the large base of the above small facets, eight quadrangular facets, eight pairs of generally Trapezoidal facets and several other pairs of either triangular or trapezoidal facets in pairs of eight. The present invention, having a significantly different angle of inclination, between the facets and the girdle plane.

U.S. Pat. No. 4,020,649 to Grossbard presents a brilliantized step cut diamond, where the cut has a step cut crown having multiple facets and a brilliant cut pavilion. The present invention has different angles of inclination of the facets.

U.S. Pat. No. 5,970,744 to Greeff discloses a cut cornered mixed cut gemstone, which has a step cut crown and a brilliant cut pavilion. The crown has two steps, a table, and a girdle. The crown and the pavilion are substantially square with four equal sides and corners about ⅓ the length of the sides. The present invention has angles of inclination of the facets, with the girdle to enhance the brilliance of the girdle.

U.S. Pat. Nos. Des. 141,258,141,259 and 143,470 to Fine teaches a brilliant cut gemstone having a multitude of facets in its crown with several corner facets and upper girdle facets.

U.S. Pat. No. 6,430,963 by the present inventions discloses a mixed cut diamond. However, the angles of inclination of the facets are significantly different.

While the prior art of a diamond cuts are of a significant interest, it does not address a specific need of a particular way of having a gemstone cut, that achieves brilliancy, scintillation and dispersion coefficients that are the same as the present invention. The present invention addresses a brilliant gemstone cut that achieve excellent coefficients for many characteristics of a gemstone, and cut to provide space for the prong of a setting, without interfering with the brilliance of the upper corner facets.

SUMMARY OF THE INVENTION

The present invention is directed towards a gemstone cut.

The main object of the present invention is to provide a brilliant cut gemstone, with a brilliant cut crown, girdle and a brilliant cut pavilion.

It is another object of the present invention to provide a brilliant cut gemstone that provides good brilliancy and scintillation.

It is another object of the present invention to provide a brilliant cut gem stone having a brilliant cut crown that has an octagon-shaped flat table and a octagon-shaped girdle, with facet angles providing for great brilliance.

It is another object of the present invention to provide a brilliant cut gemstone having a brilliant cut crown that has lower girdle facets, with a angle providing greater brilliance.

It is another object of the present invention to provide a brilliant cut gemstone having corner facets, and an inclination angle providing greater brilliance.

It is another object of the present invention to provide a brilliant cut gemstone having a brilliant cut pavilion having bezel facets where the angles of inclination to provide greater brilliance.

Other objects of the present invention might become apparent from the foregoing description.

It is another object of the invention to provide a brilliant cut gemstone having a space between the girdle and the upper corner facets for setting prongs.

BRIEF DESCRIPTION OF THE DRAWINGS

The following description of preferred embodiment of the present invention will be better understood when read in conjunction with the appended drawings. It should be understood, however, that the invention is not limited to the precise arrangements shown in which.

DETAILED DESCRIPTION OF THE PREFERRED EMBODIMENT

The present invention relates to a new gemstone cut. The present invention would be better understood in conjunction with a following description of a preferred embodiment. However, it is understood by one skilled in the art that the present invention is not limited to the above referenced specific embodiment, but other embodiments are allowable, provided they are within the scope and spirit of the following claims.

In the following description, references to the drawings, certain items are used for conciseness, clarity and comprehension. It is assumed by one skilled in the art that there are to be no unnecessary limitations implied from the such references, besides the limitations imposed by the prior art, because such terms and references are used for descriptive purposes only and intended to be broadly construed. Furthermore, the description and the drawings are for illustrative purposes only and not to be construed as limited to the exact details shown, depicted, represented, or described.

For illustrative purposes only, the present invention's preferred mode is a brilliant gemstone cut, having a brilliant cut crown consisting of a flat table, corner facets and upper girdle facets, a girdle, a brilliant cut pavilion having rib lines, bezel star facets and lower girdle facets, and superior angles of inclination of the facets with the table.

Figure 1:
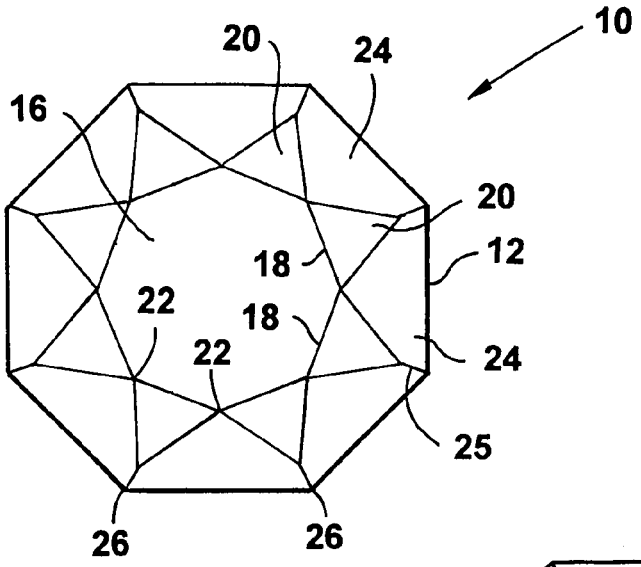
FIG. 1 is perspective view of the top of the gemstone cut showing a crown with a flat table and crown facets.
Figure 2:
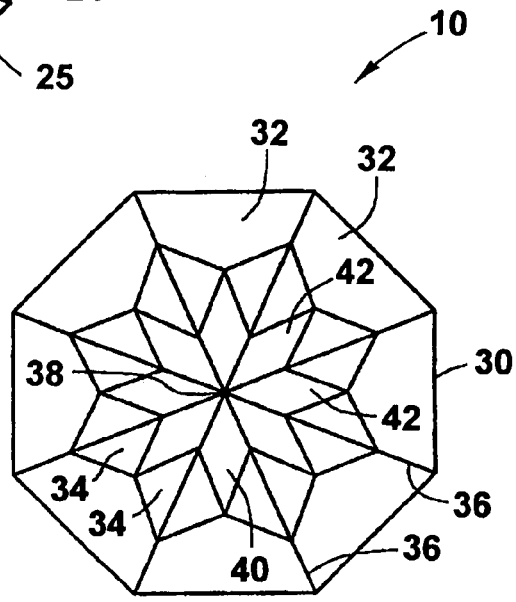
FIG. 2 is perspective view of the bottom of the gemstone cut showing a pavilion with a point culet, bezel star and its facets, and lower girdle facets.

Referring to FIG. 1, a gemstone 10 is shown from the top. The gemstone 10 has a crown 12. The crown 12 is a brilliant cut crown, having a flat table 16, several upper girdle facets 24 and corner facets 20. The table is shaped as an n-sided polygon. In this particular embodiment, the table 16 is shaped as an octagon. Referring to FIGS. 1 and 2, the table 16 and a girdle 50 are shaped equivalently, i.e., the table and a girdle are both n-sided polygons (e.g., in the pictured Embodiment, both of them are octagons).

Referring to FIG. 1, the table 16 is shown 55% to 60% of the surface of the girdle plane. The table 16 is in the form of a right octagon having vertices 22. The vertices 22 serve as vertices for upper girdle facets 24, which are five sided polygons having their bases on the girdle's plane. The crown 12 also has corner facets 20, which can also be either equilateral or isosceles triangles. The corner facets 20 have vertices 26, which are spaced from girdle's plane by the point of intersection between upper girdle facets 24. The bases 18 of corner facets 20 are the sides of octagon that encompasses the table 16.

Figure 7:
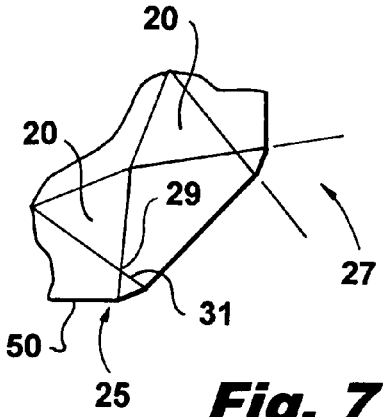
FIG. 7 shows a prong of the setting covering edge line 25.

When the stone is mounted in a setting (as shown in FIG. 7), a prong 27 of the setting will cover the edge line 25 between upper girdle facets 24 but will not cover the corner facets 20. The setting prongs will therefore not interfere with the reflections of light from the corner facets. The distance between the girdle and the vertex 29 of the upper corner facets, is between 1/10 and 1/5 of the distance between the girdle and the bases 18 of the corner facets 20. By this construction, the prongs of the setting do not interfere with the reflectivity and brilliance of the corner facets.

In one embodiment, the degree of inclination with respect to girdle's plane of corner facets 20 may range from 25-40°. Moreover, the inclination, with respect to the girdle's plane, of the upper girdle facets 24 may range from 30-45°. The present invention is not limited to this particular angular inclinations and it may be obvious to one skilled in the art that other angular inclinations are possible.

Referring to FIG. 2, the gemstone cut 10 is pictured showing its pavilion 30. The pavilion 30 has a culet 38, which in this particular embodiment is a point culet. The pavilion comprises rib lines 36, which subdivide the pavilion into equal pavilion facets. The rib lines 36 run from the girdle plane and converge at the culet 38. The number of the rib lines depends on the number of vertices that the girdle has. In this particular embodiment, there are eight rib lines in accordance with eight vertices of the girdle plane. The pavilion 30 has a bezei star 40, which the rib lines 36 subdivide into equivalent bezel facets 42. In the embodiment, there are eight equivalent facets 42. Each facet 42 is shaped as a diamond with one of its vertices being the culet 38 of the pavilion 30 and the opposite vertex being the vertex of the lower girdle facet 32. The two side adjacent to the vertex, located at the vertex of the of the lower girdle facet 32, are the sides of the corner facets 34. In this embodiment, all of the sides of the bezel star facet 42 are equivalent.

The rib lines 36 create an equal number of equivalent lower girdle facets 32. The lower girdle facets 32 are five-side polygons with its longer sides located on the girdle's plane and two of its sides along the rib lines 36. The inclination of the facets 32 with respect to the girdle's plane in this particular embodiment may range from 50°-68° however, other inclinations may be possible. The pavilion also contains an even number of corner facets 34 created by the rib lines 36 and the bezel star facets 42. The corner facets 34 are triangles with their bases adjoining, and, are located along the rib lines 36. One side of each triangle of the corner facet 34 is along the lower girdle facet 32 and the other side is along the bezel star facet 42. The number the corner facets 32 is proportional to the number of vertices that the girdle has. The number of the corner facets is twice the number of the vertices. In this particular embodiment, since the number of the vertices is eight, the number of the facets is 16. Referring to FIG. 2, in this particular Embodiment, the inclination of the bezel star facets 42 with respect to the girdle's plane may range from 38.1° to 43.9°. Moreover, the same embodiment, the inclination of the corner facets 34 with respect to the girdle's plane may range from 40.1° to 46.9°. Finally, the inclination of the lower girdle facets 32 with the respect to the girdle's plane may range from 50° to 68°.

Figure 3:
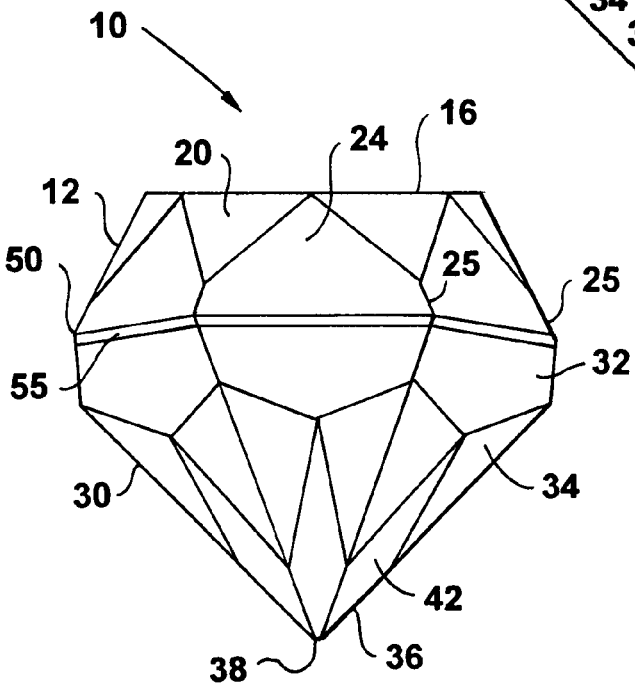
FIG. 3 is a side view of the gemstone cut showing a crown, a girdle and a pavilion with all of their respective facets.

Referring to FIG. 3, the gemstone cut 10 is depicted from its side showing the crown 12 with all of its facets, the girdle 50, and the pavilion 30 with all of its facets. The girdle 50 has a shape of an n-sided polygon in adherence with the number of the vertices that the table has. Here the girdle 50 is an equilateral octagon. The girdle 50 has small rectangular facets 55. The length of the side of the facets 55 is either the base of the upper girdle facet 24 or the lower girdle facet 32. The width side of the girdle facet is a continuation of the rib lines 36. In one embodiment, the girdle's width may range from 1-2.5% of the total height of the gemstone cut 10.

Figure 4:
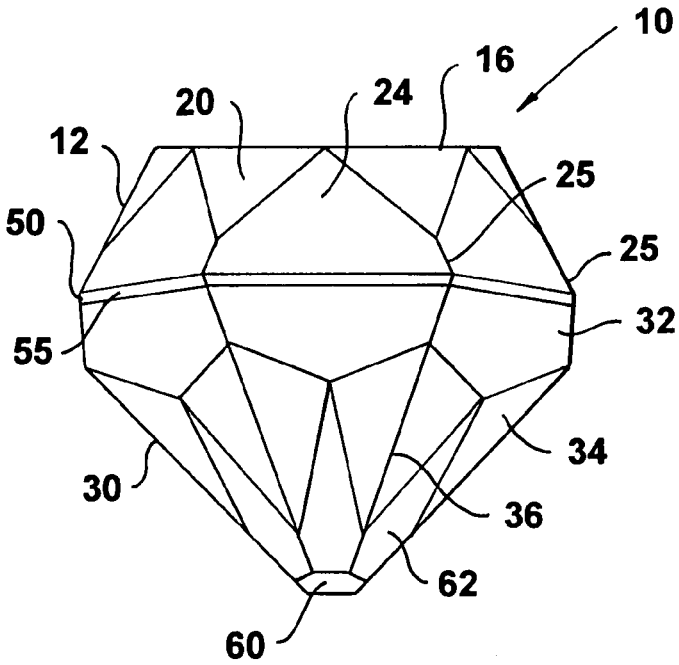
FIG. 4 is a side view of the gemstone cut showing a crown, a girdle and a pavilion with a flat culet facet.
Figure 5:
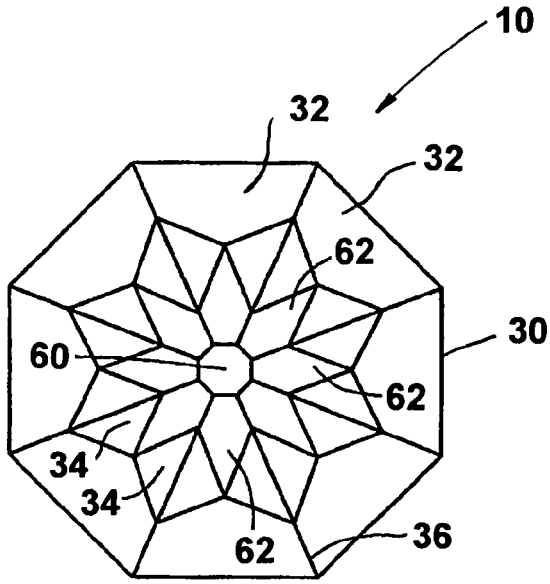
FIG. 5 is a perspective view of the gemstone cut in FIG. 4, shown from the bottom.

In yet other embodiments, referring to FIGS. 4 and 5, a culet may be chosen in a form of a polygon. FIGS. 4 and 5 depict the gemstone cut 10 with octagonal culet 60. As in the embodiments described above, the rib lines 36 run from the girdle 55 and subdivide the gemstone 10 pavilion 30 into equal parts. However, in this embodiment, the rib lines do not converge at a point, but stop at a culet facet 60. Each rib line 36 ends in one of the vertices of the octagonal culet facet 60. Moreover, the bezel star facets 62 assume a shape of a candle-like polygon, where a top portion of such polygon appears to be an isosceles triangle and a bottom portion of such polygon appears to be a equilateral trapezoid.

Figure 6A:
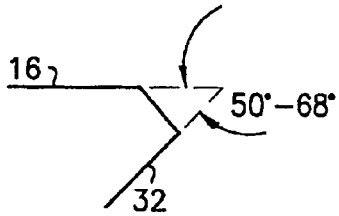
FIGS. 6A, 6B, 6C, 6D, and 6E shows the angles of the facets with respect to the plane of the table.
Figure 6B:
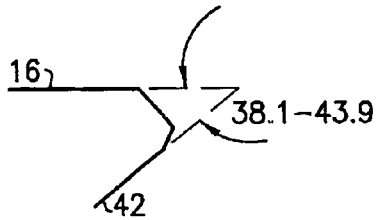
Figure 6C:
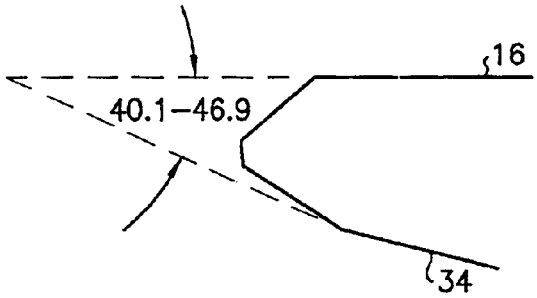
Figure 6D:
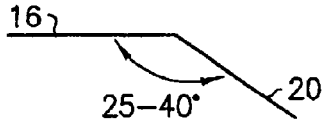
Figure 6E:
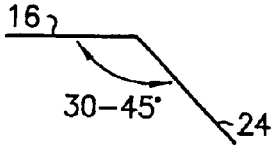

To further explain the angles of inclination: in FIG. 6A, the angle between the table 16, (which is a parallel plane to the girdle) and lower girdle facet. 32 is shown to be between 50°-68°. FIG. 6B, shows that the angle between table 16, and bezel star facet 42, as between 38.1 and 43.9°. FIG. 6C shows that the angle between the table and the corner facets 34 to be 40.1-46.9°. FIG. 6D, shows the angle between the table 16, and the upper girdle facets 24 to be between 25-40°. Finally, FIG. 6E, shows the angle between the table 16 and the upper corner facets 20, is 30-45°.

These angles provide for the greatest scintillation, and brilliance in diamond cuts because it provides the best angles of reflection for light rays.

The present invention may utilize any precious or semi-precious stones such as diamonds, rubies or any other conventionally known precious or semi-precious stones.

In the foregoing description of the invention, reference to the drawings, certain terms, have been used for clarity, conciseness and comprehension. However, no unnecessary limitations are to be implied from or because of the terms used, beyond the requirements of the prior art, because such terms are used for descriptive purposes and are intended to be broadly construed. Furthermore, the description and illustration of the invention are by way of example, and the scope of the invention is not limited to the exact details shown, represented, or described.

While the present invention has been described with reference to the specific embodiments, it is understood that the invention is not limited but rather includes any and all changes and modifications thereto which would be apparent to those skilled in the art and which come within the spirit and scope of the appended claims.

The invention claimed is:

1. A gemstone cut, wherein said gemstone cut is a brilliant cut gemstone, comprising:

a) a brilliant cut crown, the crown being located on an upper side of a girdle, said girdle having a plane and comprising n sides, wherein n is an integer, the crown including a n-sided table, n upper girdle facets and n upper corner facets, the upper girdle facets being five-sided polygons and the upper corner facets being tree-sided polygons; and b) said upper corner facets being spaced from the girdle;

c) a pavilion located on a lower side of said girdle comprising:

lower girdle facets, bezel star facets, lower corner facets, having an angle between a table and the lower girdle facets of approximately 50-60°.

2. The gemstone cut of claim 1, wherein the angle between the table and the bezel star facet is between approximately 38.1 and 43.50.

3. The gemstone cut of claim 1, wherein said n is equal to 8.

4. The gemstone cut of claim 1, wherein said table is shaped as an approximately equilateral octagon.

5. The gemstone cut of claim 1, wherein an angle between the table and the lower corner facets is approximately 40.1 to 46.9°.

6. The gemstone cut of claim 1, wherein an angle between the table and the upper girdle facets is 25-40°.

7. The gemstone cut of claim 1, wherein the angle between the girdle and the upper corner facets is 30-45°.

* * * * *